US008047763B2

(12) United States Patent
Black

(10) Patent No.: US 8,047,763 B2
(45) Date of Patent: Nov. 1, 2011

(54) ASYMMETRICAL GAS TURBINE COOLING PORT LOCATIONS

(75) Inventor: Kenneth Damon Black, Greenville, SC (US)

(73) Assignee: General Electric Company, Schenectady, NY (US)

( * ) Notice: Subject to any disclaimer, the term of this patent is extended or adjusted under 35 U.S.C. 154(b) by 560 days.

(21) Appl. No.: 12/289,567

(22) Filed: Oct. 30, 2008

(65) Prior Publication Data

US 2010/0111679 A1 May 6, 2010

(51) Int. Cl.
*F01D 9/00* (2006.01)

(52) U.S. Cl. ..... 415/1; 415/116; 415/173.2; 415/176; 415/178

(58) Field of Classification Search ..... 415/1, 173.1–173.3, 116, 175–178
See application file for complete search history.

(56) References Cited

U.S. PATENT DOCUMENTS

| | | | | |
|---|---|---|---|---|
| 4,596,116 | A * | 6/1986 | Mandet et al. | 60/785 |
| 5,049,033 | A * | 9/1991 | Corsmeier et al. | 415/173.2 |
| 5,281,085 | A * | 1/1994 | Lenahan et al. | 415/116 |
| 7,625,169 | B2 * | 12/2009 | Manzoori | 415/14 |
| 2004/0086377 | A1 * | 5/2004 | Proctor et al. | 415/116 |

* cited by examiner

*Primary Examiner* — Gary F. Paumen
(74) *Attorney, Agent, or Firm* — Nixon & Vanderhye P.C.

(57) ABSTRACT

A method is disclosed for improving a turbine's thermal response during transient and steady state operating conditions in which the flow of cooling fluid in the turbine's casing is caused to be asymmetrical relative to the horizontal and vertical symmetry planes of the casing so that the turbine's cooling symmetry planes are rotated relative to its geometric symmetry planes and thereby the heat transfer at locations in the casing with increased mass is increased.

23 Claims, 4 Drawing Sheets

ASYMMETRICAL GAS TURBINE COOLING PORT LOCATIONS

The present invention relates to gas turbines, and more particularly, to a structure for and method of improving a turbine's thermal response during transient and steady state operating conditions.

BACKGROUND OF THE INVENTION

"Out-of-roundness" in a turbine's stator casing directly impacts the performance of the machine due to the additional clearance required between the machine's rotating and stationary parts. As clearances are reduced, machine efficiency and output increase.

Turbine stator casings are typically comprised of a semi-cylindrical upper half and a semi-cylindrical lower half that are joined together at horizontal split-line joints that can have an effect on a casing's roundness. Attempts have been made to reduce the out-of-roundness effects associated with the use of horizontal joints by adding false flanges, which add mass at discrete locations, such as at the vertical plane of the casing. However, the added mass from the use of false flanges typically causes a thermal "lag" during the transient response of the machine.

One approach to solving this problem has been to use the symmetrical placement of bosses and/or cooling flows relative to the vertical and horizontal planes of the turbine casing. But the symmetrical placement of bosses and/or cooling flows has resulted in reduced cooling flows at the joints and flanges.

Another approach has been to add fins in the cooling passage of the casing at the circumferential locations where the flanges are located, so as to provide more surface area for improved cooling and heating. But this approach is limited when cooling flows are reduced due to symmetry planes. By increasing heat transfer in those regions where the horizontal joints and false flanges are located, "out-of-roundness" can be reduced, which, in turn, allows machine clearances to be reduced.

BRIEF DESCRIPTION OF THE INVENTION

In an exemplary embodiment of the invention, a turbine casing with increased heat transfer at locations with increased mass comprises an upper casing half with first and second upper flanges, a lower casing half with first and second lower flanges, the upper flanges being joined to corresponding lower flanges to thereby join the upper and lower casing halves to one another to form the casing, the joined flanges being positioned substantially at the horizontal symmetry plane of the casing, a first false flange positioned on the upper casing half substantially at the vertical symmetry plane of the casing, a second false flange positioned on the lower casing half substantially at the vertical symmetry plane of the casing, a plenum located within and extending circumferentially around the turbine casing within which a cooling fluid flows circumferentially around the turbine casing, and a plurality of bosses positioned around the circumference of the casing for introducing the cooling fluid into the plenum at a plurality of locations around the circumference of the casing so that the cooling fluid has first and second flow symmetry planes that do not correspond to the horizontal and vertical symmetry planes of the turbine casing and the heat transfer is increased at the joined upper and lower flanges and at the first and second false flanges located at the horizontal and vertical symmetry planes, respectively, of the turbine casing.

In another exemplary embodiment of the invention, a turbine casing with increased heat transfer at locations with increased mass comprises a semi-cylindrical upper casing half with first and second upper flanges extending generally radially from opposite ends of the upper casing half, a semi-cylindrical lower casing half with first and second lower flanges extending generally radially from opposite ends of the lower casing half, the upper flanges being joined to corresponding lower flanges to thereby join the upper and lower casing halves to one another to form the casing, the joined flanges being positioned substantially at the horizontal symmetry plane of the casing, a plurality of flanges extending generally radially from the upper and lower casing halves, a first of the plurality of flanges being sized and/or dimensioned to substantially match the stiffness and the thermal mass of each of the joined upper and lower flanges together, and being positioned on the upper casing half substantially at the vertical symmetry plane of the casing, a second of the plurality of flanges being sized and/or dimensioned to substantially match the stiffness and the thermal mass of each of the joined upper and lower flanges together, and being positioned on the upper casing half substantially at the vertical symmetry plane of the casing, and a plurality of bosses positioned around the circumference of casing for providing cooling fluid to a plenum located within the casing so that the cooling fluid travels circumferentially around the turbine casing in the plenum, such that the cooling fluid has flow symmetry planes that are shifted relative the horizontal and vertical symmetry planes of the turbine casing, whereby heat transfer is increased at the joined upper and lower flanges and at the first and second flanges located at the horizontal and vertical symmetry planes, respectively, of the turbine casing.

In a further exemplary embodiment of the invention, a method of increasing heat transfer at turbine casing locations with increased mass comprises the steps of providing an upper casing half with first and second upper flanges, providing a lower casing half with first and second lower flanges, joining the upper flanges to corresponding lower flanges to thereby join the upper and lower casing halves to one another to form the casing, and thereby position the joined flanges substantially at the horizontal symmetry plane of the casing, providing a first false flange on the upper casing half substantially at the vertical symmetry plane of the casing, providing a second false flange on the lower casing half substantially at the vertical symmetry plane of the casing, providing a plenum within and extending circumferentially around the turbine casing, causing a cooling fluid to flow circumferentially around the turbine casing, and positioning a plurality of bosses around the circumference of the casing to introduce the cooling fluid into the plenum at a plurality of locations around the circumference of the casing so that the cooling fluid has first and second flow symmetry planes that do not correspond to the horizontal and vertical symmetry planes of the turbine casing and the heat transfer is increased at the joined upper and lower flanges and at the first and second false flanges located at the horizontal and vertical symmetry planes, respectively, of the turbine casing.

DETAILED DESCRIPTION OF THE INVENTION

Prior art solutions to reduce out of roundness in gas turbine stator casings have used symmetrical placement of bosses and cooling flows, whereas the present invention uses asymmetrical placement of cooling flows (that can be asymmetrical in placement relative to the specific planes or in mass flow rates within a plenum) to increase heat transfer at desired locations.

Figure 1:
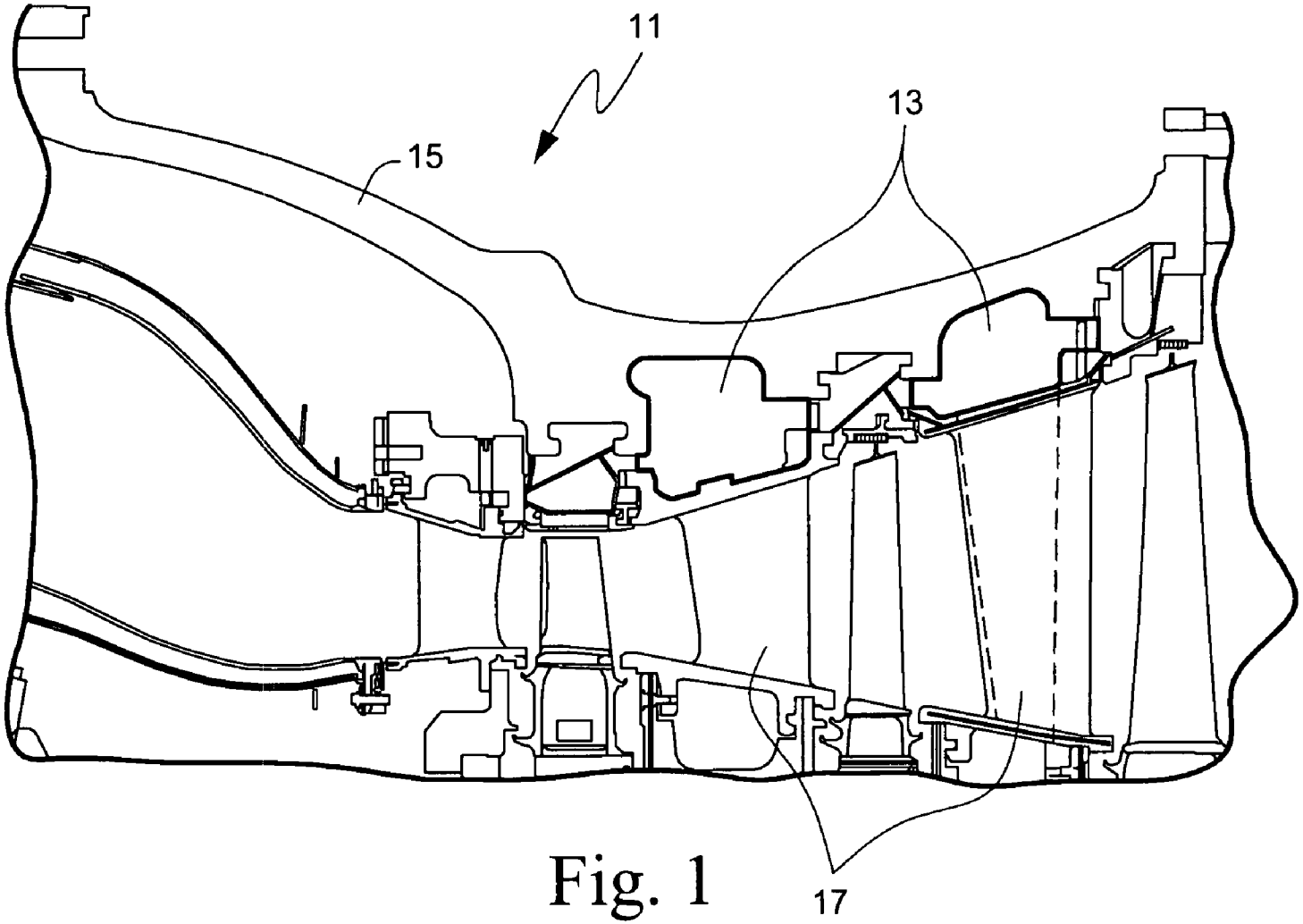
FIG. 1 is a partial cross-sectional view of a conventional gas turbine showing the plenum in the turbine's outer stator casing for supplying cooling fluid to static vanes (nozzles) attached to the turbine's outer flow path wall.

FIG. 1 is a partial cross-sectional view of a conventional gas turbine 11 showing a plenum 13 in the turbine's outer stator casing 15 for supplying cooling fluid to static nozzle guide vanes 17 attached to the turbine's outer flow path wall.

Figure 2:
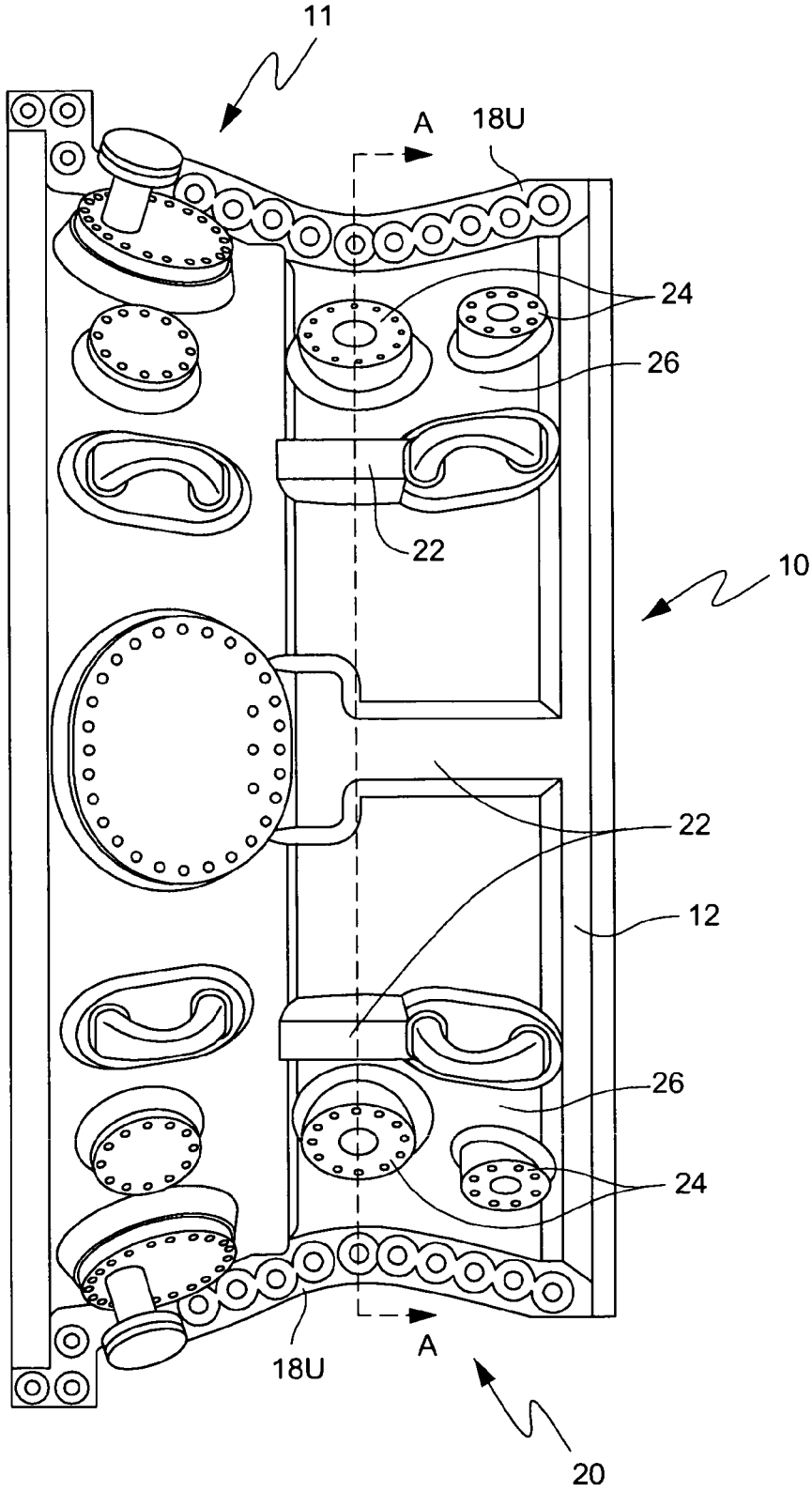
FIG. 2 is a top view of a conventionally configured turbine casing showing horizontal joints at which casing halves are joined together and false flanges positioned circumferentially around the turbine casing.
Figure 3:
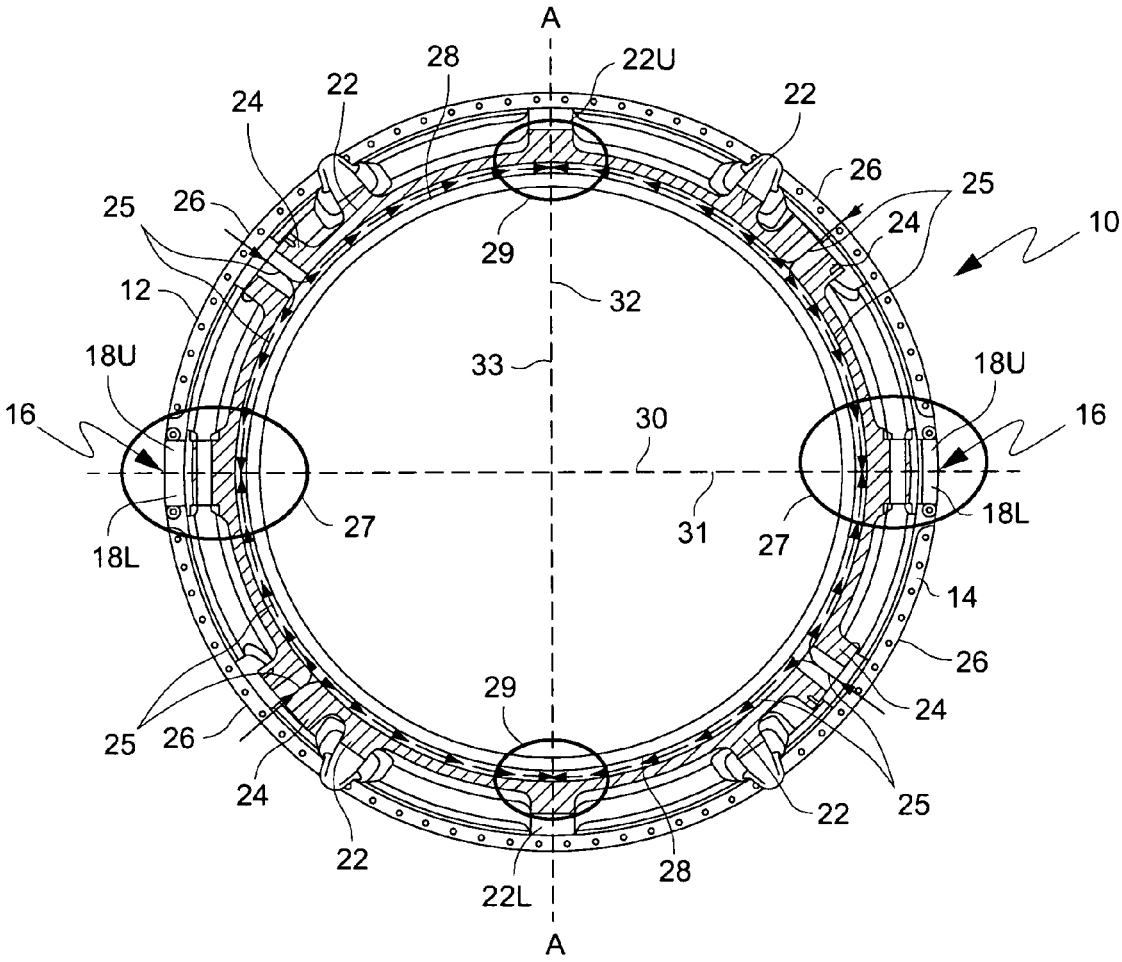
FIG. 3 is a cross-sectional view, taken along line A-A in FIG. 2, of the conventionally configured turbine casing of FIG. 1 showing the turbine casing's geometric symmetry planes and its cooling symmetry planes circumferentially coinciding with one another.

FIG. 2 is a top view of a gas turbine shell or casing 10, while FIG. 3 is a cross-sectional view of the gas turbine casing 10 taken along the line A-A in FIG. 2. As shown in FIG. 3, casing 10 is generally cylindrical in shape. Casing 10 is comprised of a semi-cylindrical upper half 12 and a semi-cylindrical lower half 14 that are joined together at horizontal split-line joints 16. Each of horizontal split-line joints 16 is formed from a pair of upper and lower flanges 18U and 18L. Upper flanges 18U extend generally radially from diametrically opposite ends of upper casing half 12. Lower flanges 18L extend generally radially from diametrically opposite ends of lower casing half 14. Flanges 18U and 18L also extend generally horizontally along diametrically opposed sides of the cylindrical halves 12 and 14. Preferably, flanges 18U are bolted to corresponding flanges 18L, to thereby join the casing halves 12 and 14 to one another to form turbine casing 10, although it should be noted that other methods of joining such flanges together, other than bolting, could be used.

Also shown in FIGS. 2 and 3 are a plurality of "false" flanges 22 that are spaced circumferentially from one another along the circumference of casing 10. In the embodiment of turbine casing 10 shown in FIGS. 2 and 3, each of flanges 22 is spaced diametrically opposite another flange 22 on casing 10. Each of flanges 22 extends generally radially from and horizontally along the sides of casing halves 12 and 14.

Two of the "false" flanges 22U and 22L are each spaced approximately 90° circumferentially from the horizontal split-line joints 16 and diametrically opposite one another on casing 10. Typically, false flanges 22U and 22L are each sized and/or dimensioned to substantially match the stiffness and the thermal mass of one of the split-line joints 16.

The turbine section of a gas turbine typically has static vanes or nozzles (not shown in FIG. 3 and FIG. 4) attached to the outer flow path wall of the turbine casing. One means of allowing the nozzles to operate at high temperatures is to provide cooling fluid, such as air, to the nozzles. Typically, the cooling fluid is provided to the individual nozzles by pipes (not shown) attached to the outer wall of casing 10 through bosses 24 located at discrete locations around the circumference of casing 10. The cooling fluid passes through the pipes, bosses 24 and the outer wall 26 of casing 10, and into a plenum 28 located within casing 10, but outboard of the nozzles. As shown by the arrows 25 in FIG. 3, the cooling fluid 25 then travels circumferentially around the turbine casing 10 in plenum 28 to access the individual nozzles.

In an effort to minimize features that may affect roundness of the structural casing 10, and thus machine clearances, the bosses 24 where the cooling fluid pipes are attached to casing 10 are typically positioned symmetrically relative to the machine's horizontal symmetry plane 31 and/or vertical symmetry plane 33. One adverse effect from this symmetrical positioning of the cooling fluid pipes and bosses 24 is that the cooling supply symmetry planes 30 and 32 are coincident with the geometric symmetry planes 31 and 33 of casing 10, which results in reduced cooling flow at locations 27 and 29 shown in FIG. 3. Locations 27 and 29 correspond to split-line joints 16 and false flanges 22U and 22L. On turbines that have bolted horizontal joints, like joints 16, and false flanges at the vertical plane 33, like false flanges 22U and 22L, the additional mass related to the flanges has a different thermal transient response and steady state temperature profile relative to the axis-symmetric portion of the stator casing 10. This effect can be compounded if it is also a plane of symmetry in the cooling plenum 28 where there are reduced cooling flows. Thus, in areas 27 and 29 circumferentially coincident with structural horizontal joints 16 and with structural false flanges 22U and 22L, respectively, there is reduced cooling fluid flow velocity, and thus heat transfer coefficients ("HTCs").

Figure 4:
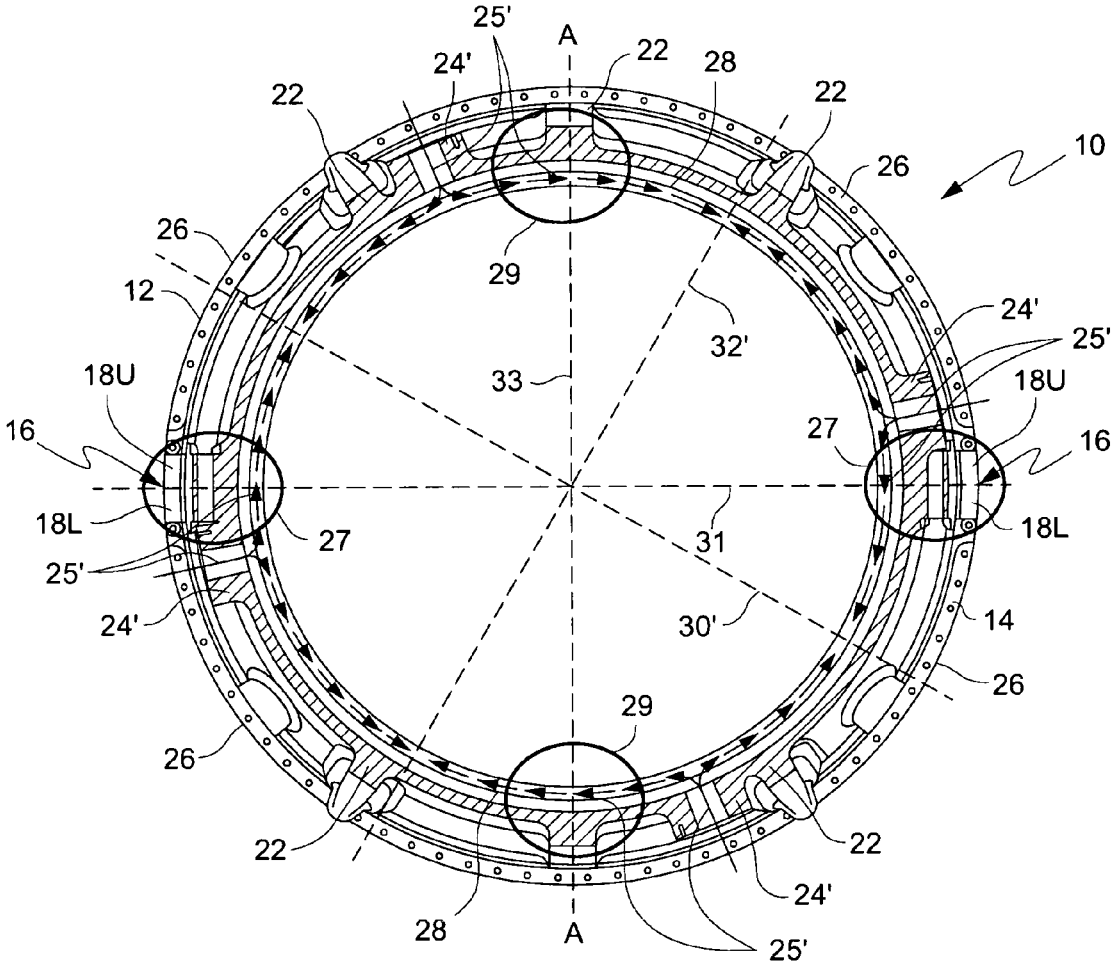
FIG. 4 is a cross-sectional view, taken along line A-A, of the turbine casing of FIG. 2, but showing an embodiment of the present invention in which the turbine casing's cooling symmetry planes have been shifted so as to not coincide with the casing's geometric symmetry planes.

FIG. 4 is a cross-sectional view of the gas turbine casing 10 shown in FIGS. 2 and 3, again taken along the line A-A in FIG. 2, but modified to show the re-positioning of bosses 24 to the locations of bosses 24' to improve cooling fluid flow in locations 27 and 29. The cross-sectional view of turbine casing 10 shown in FIG. 4 is an exemplary embodiment of the structure and method of the present invention for controlling distortion in a turbine casing 10, by moving the cooling supply ports, such as bosses 24 through which the cooling fluid pipes are attached to the outer wall 28 of casing 10. In the embodiment of FIG. 4, the cooling supply symmetry planes 30 and 32 are shifted so that shifted cooling supply symmetry planes 30' and 32' are not coincident with the geometric symmetry planes 31 and 33 of casing 10. This allows for better convective heat transfer at the locations 27 of joints 16 and 29 of false flanges 22U and 22L, where there is increased mass. This shift in cooling supply symmetry planes 30' and 32' has a positive impact on the transient and steady state clearances of casing 10.

In the embodiment of FIG. 4, the problem of reduced cooling flow is solved by repositioning the cooling supply ports fed by bosses 24', so that the cooling supply symmetry planes 30' and 32' are not coincident with the geometric symmetry planes 31 and 33. This allows for better convective heat transfer at locations 27 and 29 where there is increased mass due to joints 16 and false flanges 22U and 22L being located there. This, in effect, has a positive impact on the transient and steady state clearances of the machine. The present invention uses asymmetrical placement of the cooling ports (bosses 24) on the turbine casing 10 to increase the flow (and associated heat transfer) at the horizontal joint and false flange locations 27 and 29. The placement of bosses 24' can be optimized to increase the heat transfer at the axis-symmetric regions, while increasing it at the asymmetric regions 27 and 29.

In practice, the bosses 24' shown in FIG. 4 are repositioned bosses 24, moved to coincide with the desired entry point of the cooling flow 25'. The range in degrees by which the 24' can be shifted away from the positions of bosses 24 that coincide with axis-symmetric placement depends on the actual number of entry points. As shown in FIGS. 3 and 4, with an entry point on boss 24 at every 45 degrees above and below the horizontal joint 31, the bosses 24'/cooling flows 25' can be re-positioned until interference with the horizontal joint 16 becomes an issue (i.e., at approximately 35 degrees).

If there are four bosses 24, as shown in FIG. 3, then repositioning the bosses 24 45° or 135° puts a boss 24, right on the horizontal joint 16, which is an undesirable configuration. However, if there are twice as many entry points, then the angle of rotation of bosses 24' would be much smaller before interference with the horizontal joint 16 occurred. As the bosses 24' are repositioned from the location shown in FIG. 3 towards the horizontal plane 31, the impact of the cooling flow 25' on the horizontal joints 16 increases. There is no set "best case". The result of repositioning bosses 24' is configuration specific, depending on the relative difference in thickness between the horizontal joint 16 and the casing wall 10, and the mass flow rate of the cooling air 25'. The significant feature of the present invention is that the positioning of the bosses 24 is such that the cooling flow 25 provided by them is tunable, whereby the bosses 24 can be repositioned as bosses 24' to achieve cooling flow 25' past the horizontal joints 16 and false flanges 22U and 22L in the embodiment of FIG. 4, whereas in the original configuration of FIG. 3 there is no cooling flow past the horizontal joints 16. Thus, the cooling flow has a very different impact on the casing 10 at the horizontal joint location 16.

The positions of the bosses 24 can be optimized to provide better heat transfer coefficients not only at the horizontal joints 16 and the false flanges 22U and 22L, but also at other locations, such as lifting lug reinforcement pads, etc. Also changing the positions of the bosses 24 does not eliminate the possibility of using the same casting Part Number on the upper and lower halves of a casing 10 where false bosses are incorporated.

By moving the cooling supply flow of symmetry away from being coincident with the horizontal joints 16 and/or false flanges 22U and 22L, improved heat transfer coefficients can be achieved in these areas 27 and 29. This improves the thermal response during transient and steady state operating conditions of the turbine. To ensure that "out-of-roundness" is not introduced due to asymmetrical positioning of the bosses, false bosses can be added/optimized as required.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine casing with increased heat transfer at locations with increased mass, the casing comprising:

an upper casing half with first and second upper flanges, a lower casing half with first and second lower flanges, the upper flanges being joined to corresponding lower flanges to thereby join the upper and lower casing halves to one another to form the casing, the joined flanges being positioned substantially at the horizontal symmetry plane of the casing, a plenum located within and extending circumferentially around the turbine casing within which a cooling fluid flows circumferentially around the turbine casing, and a plurality of bosses positioned around the circumference of the casing for introducing the cooling fluid into the plenum at a plurality of locations around the circumference of the casing so that the cooling fluid has first and second flow symmetry planes that do not correspond to the horizontal and vertical symmetry planes of the turbine casing and the heat transfer is increased at the joined upper and lower flanges located at the horizontal symmetry plane of the turbine casing.

2. The casing of claim 1 further comprising:

a first false flange positioned on the upper casing half substantially at the vertical symmetry plane of the casing, and a second false flange positioned on the lower casing half substantially at the vertical symmetry plane of the casing, and wherein the heat transfer is also increased at the first and second false flanges located at the vertical symmetry plane of the turbine casing.

3. The casing of claim 2, wherein the flow of cooling fluid in the casing is asymmetrical relative to the horizontal and vertical symmetry planes of the casing so that heat transfer at the joined upper and lower flanges and at the first and second false flanges is increased.

4. The casing of claim 1, wherein each of the plurality of bosses is located more than 0° but less than 45° away from the horizontal symmetry plane or from the vertical symmetry plane of the casing.

5. The casing of claim 1, wherein each of the plurality of bosses is located at a position around the circumference of the casing such that the first and second flow symmetry planes of the cooling fluid flowing in the plenum is more than 0° but less than 45° away from the horizontal symmetry plane or from the vertical symmetry plane of the casing.

6. The casing of claim 2, wherein each of the plurality of bosses is located at a position around the circumference of the casing such that the heat transfer at the joined upper and lower flanges and at the first and second false flanges due to the flow of cooling fluid past the flanges is maximized.

7. The casing of claim 5, wherein the first and second cooling fluid flow symmetry planes are substantially perpendicular to one another.

8. The casing of claim 3, wherein each of the first and second false flanges is sized and/or dimensioned to substantially match the stiffness and the thermal mass of each of the joined upper and lower flanges together.

9. The casing of claim 1, wherein the plurality of bosses is comprised of four bosses being positioned around the circumference of the casing at approximately 90° intervals.

10. A turbine casing with increased heat transfer at locations with increased mass, the casing comprising:

a semi-cylindrical upper casing half with first and second upper flanges extending generally radially from opposite ends of the upper casing half, a semi-cylindrical lower casing half with first and second lower flanges extending generally radially from opposite ends of the lower casing half, the upper flanges being joined to corresponding lower flanges to thereby join the upper and lower casing halves to one another to form the casing, the joined flanges being positioned substantially at the horizontal symmetry plane of the casing, and a plurality of bosses positioned around the circumference of casing for providing cooling fluid to a plenum located within the casing so that the cooling fluid travels circumferentially around the turbine casing in the plenum, such that the cooling fluid has flow symmetry planes that are shifted relative to the horizontal and vertical symmetry planes of the turbine casing, whereby heat transfer is increased at the joined upper and lower flanges located at the horizontal symmetry plane of the turbine casing.

11. The casing of claim 10 further comprising:

a plurality of flanges extending generally radially from the upper and lower casing halves, a first of the plurality of flanges being sized and/or dimensioned to substantially match the stiffness and the thermal mass of each of the joined upper and lower flanges together, and being positioned on the upper casing half substantially at the vertical symmetry plane of the casing, and a second of the plurality of flanges being sized and/or dimensioned to substantially match the stiffness and the thermal mass of each of the joined upper and lower flanges together, and being positioned on the upper casing half substantially at the vertical symmetry plane of the casing, and wherein the heat transfer is also increased at the first and second flanges located at the vertical symmetry plane of the turbine casing.

12. The casing of claim 10, wherein each of the plurality of bosses is located more than 0° but less than 45° away from the horizontal symmetry plane or from the vertical symmetry plane of the casing.

13. The casing of claim 10, wherein each of the plurality of bosses is located at a position around the circumference of the casing such that the first and second flow symmetry planes of the cooling fluid flowing in the plenum is more than 0° but less than 45° away from the horizontal symmetry plane or from the vertical symmetry plane of the casing.

14. The casing of claim 11, wherein each of the plurality of bosses is located at a position around the circumference of the casing such that the heat transfer at the joined upper and lower flanges and at the first and second false flanges due to the flow of cooling fluid past the flanges is tuned to be maximized.

15. The casing of claim 13, wherein the first and second cooling fluid flow symmetry planes are substantially perpendicular to one another.

16. The casing of claim 12, wherein each of the first and second false flanges is sized and/or dimensioned to substantially match the stiffness and the thermal mass of each of the joined upper and lower flanges together.

17. The casing of claim 10, wherein the plurality of bosses is comprised of four bosses being positioned around the circumference of the casing at approximately 90° intervals.

18. A method of increasing heat transfer at turbine casing locations with increased mass, the method comprising the steps of:

providing an upper casing half with first and second upper flanges, providing a lower casing half with first and second lower flanges, joining the upper flanges to corresponding lower flanges to thereby join the upper and lower casing halves to one another to form the casing, and thereby position the joined flanges substantially at the horizontal symmetry plane of the casing, providing a plenum within and extending circumferentially around the turbine casing, causing a cooling fluid to flow circumferentially around the turbine casing, and positioning a plurality of bosses around the circumference of the casing to introduce the cooling fluid into the plenum at a plurality of locations around the circumference of the casing so that the cooling fluid has first and second flow symmetry planes that do not correspond to the horizontal and vertical symmetry planes of the turbine casing and the heat transfer is increased at the joined upper and lower flanges and at the first and second false flanges located at the horizontal and vertical symmetry planes, respectively, of the turbine casing.

19. The method of claim 18 further comprising the steps of:

providing a first false flange on the upper casing half substantially at the vertical symmetry plane of the casing, and providing a second false flange on the lower casing half substantially at the vertical symmetry plane of the casing, wherein the heat transfer is also increased at the first and second false flanges located at vertical symmetry plane of the turbine casing.

20. The method of claim 18, wherein the step of positioning the plurality of bosses around the circumference of the casing comprises locating each of the bosses around the circumference of the casing so that the flow of cooling fluid in the casing is asymmetrical relative to the horizontal and vertical symmetry planes of the casing, whereby heat transfer at the joined upper and lower flanges and at the first and second false flanges is increased.

21. The method of claim 18, wherein the step of positioning the plurality of bosses around the circumference of the casing comprises locating each of the bosses more than 0° but less than 45° away from the horizontal symmetry plane or from the vertical symmetry plane of the casing.

22. The method of claim 18, wherein the step of positioning the plurality of bosses around the circumference of the casing comprises locating each of the bosses a position around the circumference of the casing such that the first and second flow symmetry planes of the cooling fluid flowing in the plenum is more than 0° but less than 45° away from the horizontal symmetry plane or from the vertical symmetry plane of the casing.

23. The method of claim 18, wherein the step of positioning the plurality of bosses around the circumference of the casing comprises locating each of the plurality of bosses at a position around the circumference of the casing such that the heat transfer at the joined upper and lower flanges and at the first and second false flanges due to the flow of cooling fluid past the flanges is tuned to be maximized.

* * * * *